US006733422B2

(12) United States Patent
Wu et al.

(10) Patent No.: US 6,733,422 B2
(45) Date of Patent: May 11, 2004

(54) HIDDEN ROLLER OF A TREADMILL

(76) Inventors: Peter Wu, No.1, Lane 233, Sec.2, Charng Long Rd., Taiping 411 (TW); Leao Wang, No.1, Lane 233, Sec.2, Charng Long Rd., Taiping 411 (TW)

( * ) Notice: Subject to any disclaimer, the term of this patent is extended or adjusted under 35 U.S.C. 154(b) by 0 days.

(21) Appl. No.: 10/228,750

(22) Filed: Aug. 27, 2002

(65) Prior Publication Data

US 2004/0043872 A1 Mar. 4, 2004

(51) Int. Cl.[7] ..... A63B 22/02
(52) U.S. Cl. ..... 482/54; 482/51
(58) Field of Search ..... 482/54, 51, 70, 482/71

(56) References Cited

U.S. PATENT DOCUMENTS 6,174,268 B1 * 1/2001 Novak ..... 482/54
6,189,846 B1 * 2/2001 Wang ..... 248/188.1
6,419,612 B1 * 7/2002 Yu ..... 482/54

* cited by examiner

*Primary Examiner*—Nicholas D. Lucchesi
*Assistant Examiner*—Tam Nguyen
(74) *Attorney, Agent, or Firm*—Troxell Law Office PLLC; Kuo-Hsiung Chiu

(57) ABSTRACT

The present invention relates to a hidden roller of a treadmill. A hidden roller set is pivotably connected at the bottom end of both hollow support arms by means of a pivot, respectively. As a result, the hidden roller sets can be received inside the hollow support arms when the treadmill base is placed in operational state, thereby avoiding an unexpected sliding shift. To the contrary, the hidden roller sets can be taken out when the treadmill base is folded up in storage position. Thus, the rollers are in contact with the ground and work with the fixed type roller set at the rear end of the base frame. Accordingly, the treadmill can be smoothly moved.

2 Claims, 3 Drawing Sheets

HIDDEN ROLLER OF A TREADMILL

BACKGROUND OF THE INVENTION

1. Fields of the Invention

The present invention relates to a hidden roller of a treadmill, and more particularly, to a device which ensures the operation safety and achieves the practicalness.

2. Description of the Prior Art

Rollers fitted at the bottom of treadmills are used to facilitate a smooth movement of the treadmill, thereby achieving the laborsaving effect. A typical product is disclosed in U.S. Pat. No. 5,672,140 that describes roller sets are axially and pivotably arranged at one end of the ground-touching cross bars at both sides of the bottom of the treadmill while the roller sets in storage position are not in contact with the ground. In use, the roller sets are used as a pivoting point to incline the main body of the treadmill so as to facilitate the movement of the treadmill. Although this prior art can exactly reach the expected effect, it's difficult for weak people to incline the heavy treadmill during its whole movement. Even, this could lead to an unnecessary accident.

Besides, the design of four rollers directly and permanently in contact with the ground can be seen in U.S. Pat. No. 5,372,559. However, this kind of structure will cause an unexpected sliding or shaking when the treadmill is operated. As a result, the safety of the user is seriously affected and it gradually becomes extinct on the market.

In order to effectively resolve the above-mentioned problems, a support member is provided at proper position of the roller set so as to increase the frictional resistance with the ground. This structure is disclosed in U.S. Pat. No. 6,090,016. However, a swinging see-saw effect will be created when the treadmill is moved on an uneven surface, thereby leading to inconvenience and difficulty of the horizontal adjustment.

SUMMARY OF THE INVENTION

In consideration of the above-mentioned, the inventor of the present invention thinks that the displacement of the treadmill is not a regular action. In operational position, it's not required to use the roller sets. In storage position, it's not necessarily required to shift the treadmill. As a result, partial roller sets can be stored and kept away from the ground so as to eliminate the unexpected sliding shift. In brief, all rollers are pulled out only when it's really required to displace the treadmill. It is a primary object of the present invention to provide a hidden roller of a treadmill that is arranged in the hollow upright support so as to eliminate the above-mentioned drawbacks.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
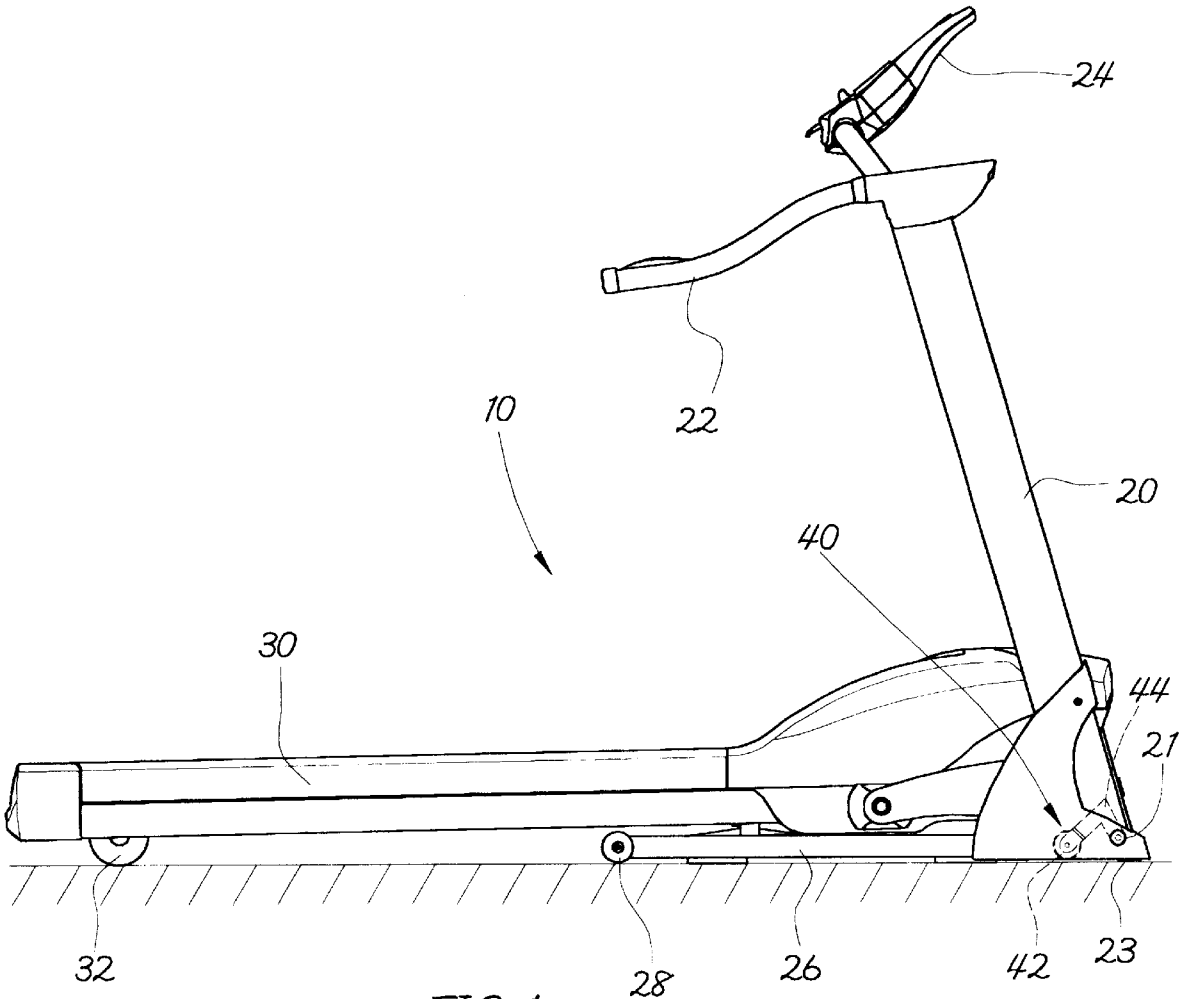
FIG. 1 is a side view of the present invention showing the position of the hidden rollers when the treadmill base is placed in operational position.
Figure 2:
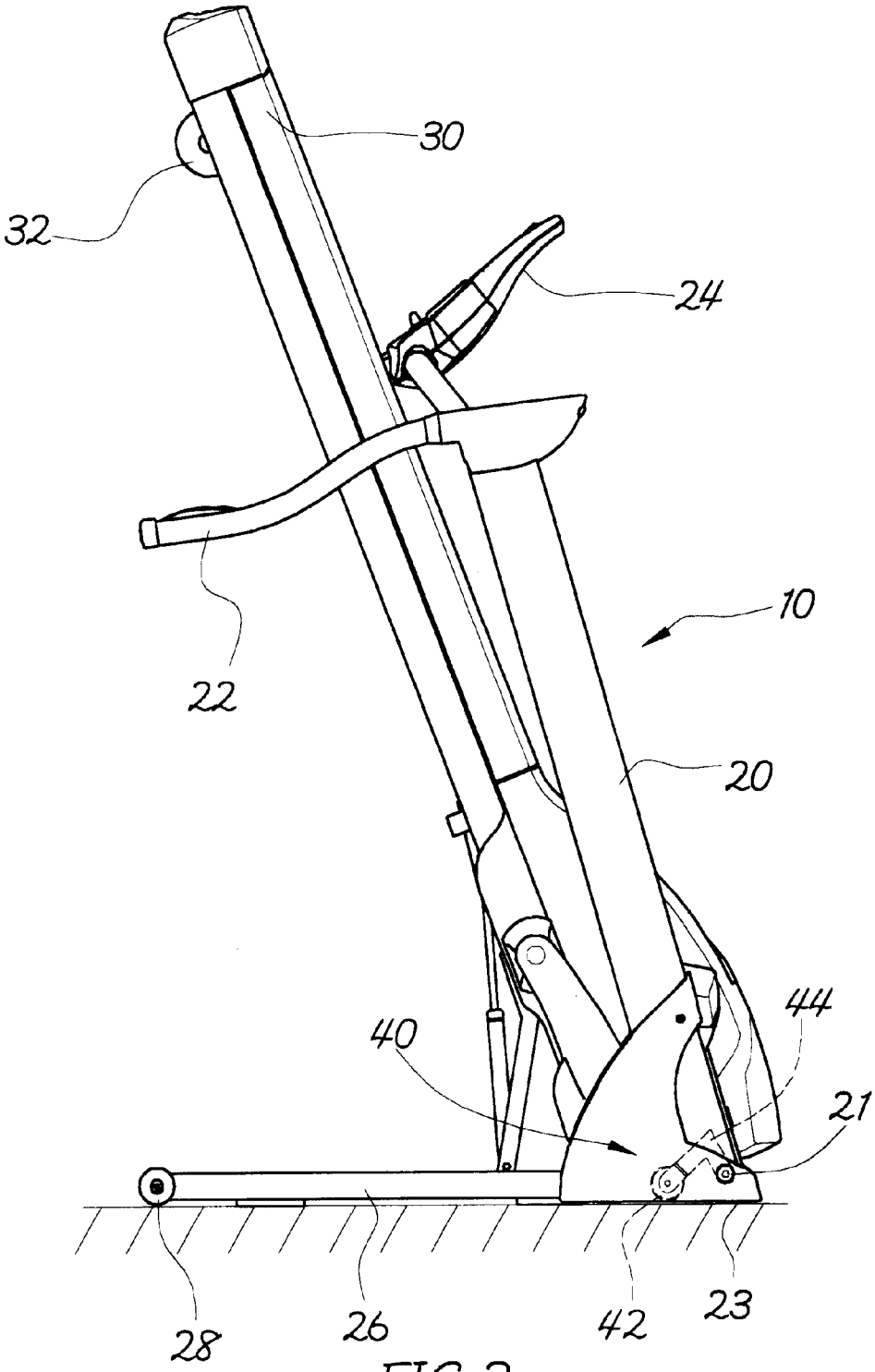
FIG. 2 is a side view of the present invention showing the position of the hidden rollers when the treadmill base is folded-up in storage position.
Figure 3:
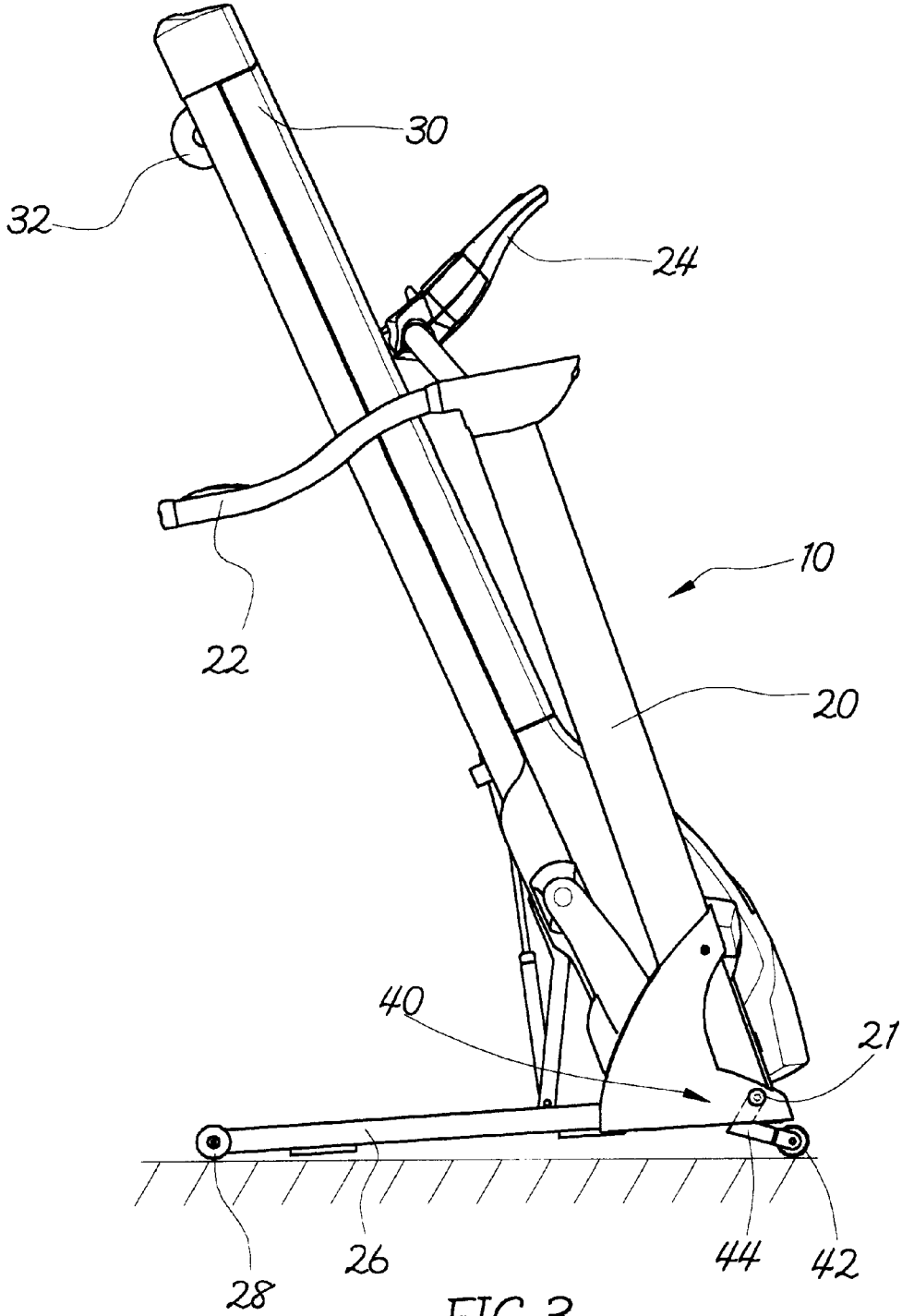
FIG. 3 is a side view of the present invention showing the hidden roller extended outside and the position of the hidden roller when the treadmill base is folded-up in storage position.

First of all, referring to FIGS. 1, 2 and 3, the treadmill 10 in accordance with the present invention includes two hollow support arms 20 and a treadmill base 30. The hollow support arms 20 are fitted to both sides of the front end of the treadmill base 30. The top of the hollow support arms 20 is provided with handle bars 22 and an electrical console 24 while a base frame 26 is formed at the bottom thereoof. A fixed type roller set 28 is disposed at the rear end of the base frame 26.

The treadmill base 30 is rectangular and has a treadmill walking belt (not shown) driven by motor transmission elements (not shown). A ground-touching support wheel 32 is fitted to both inner sides at the bottom of the rear end of the treadmill base 30, respectively.

A hidden roller set 40 is pivotably connected at the bottom end of both hollow support arms 20 by means of a pivot 21, respectively. As a result, the hidden roller sets 40 can be received inside the hollow support arms 20 when the treadmill base 30 is placed in operational state, thereby avoiding an unexpected sliding shift. To the contrary, the hidden roller sets 40 can be taken out when the treadmill base 30 is folded up in storage position. Thus, the rollers 42 are in contact with the ground and work with the fixed type roller set 28 at the rear end of the base frame 26. Accordingly, the treadmill can be smoothly moved.

The hidden roller set 40 consists of an angled bar 44 and a roller 42. The roller 42 can be received or taken out in combination with the angled bar 44. When the roller 42 juts out, it leans against the angled bar 44 by means of a stop 23 to position the roller 42.

In order to prevent the hidden roller set 40 from unexpected jutting out, the hidden roller set 40 has to be pivotably connected in a firmer way. This technique belongs to prior art so that no further descriptions are given hereinafter.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A treadmill comprising:

two hollow support arms fitted to both sides of the a front end of a treadmill base, two handle bars and an electrical console being provided at tops of said hollow support arms while a base frame is formed at a bottom thereof, a fixed type roller set being disposed at a rear end of the base frame;

a treadmill base being rectangular and having a ground-touching support wheel fitted to both inner sides at a bottom of a rear end of said treadmill base, respectively; and hidden roller sets pivotally connected at a bottom ends of both hollow support arms by means of a pivot, respectively, so that said hidden roller sets are received inside said hollow support arms when said treadmill base is placed in an operational state, thereby avoiding an unexpected sliding shift, and wherein said hidden roller sets are taken out when said treadmill base is folded up in a storage position so that rollers are in contact with the ground and work with said fixed type roller set at the rear end of said frame; accordingly, the treadmill is smoothly moved.

2. The treadmill according to claim 1, wherein each hidden roller set is composed of an angled bar and a roller, and wherein said roller is received or taken out in combination with said angled bar, and wherein said roller leans against said angled bar by a stop to limit its movement when said roller juts out.

* * * * *